US007537139B2

(12) United States Patent
Jackson et al.

(10) Patent No.: US 7,537,139 B2
(45) Date of Patent: May 26, 2009

(54) DUAL CHAMBER PISTON PRESSURE PACK DISPENSER SYSTEM

(75) Inventors: Scott Jackson, Olmsted Township, OH (US); Michael Terhardt, Westlake, OH (US)

(73) Assignee: Henkel Corporation, Rocky Hill, CT (US)

( * ) Notice: Subject to any disclaimer, the term of this patent is extended or adjusted under 35 U.S.C. 154(b) by 599 days.

(21) Appl. No.: 11/140,188

(22) Filed: May 27, 2005

(65) Prior Publication Data

US 2006/0266769 A1 Nov. 30, 2006

(51) Int. Cl.
*B67D 5/52* (2006.01)

(52) U.S. Cl. ..... 222/135; 222/145.5

(58) Field of Classification Search ..... 222/135–142, 222/402.115, 460, 469, 470, 145.5–145.8, 222/402.15, 134, 635, 309, 340, 402
See application file for complete search history.

(56) References Cited

U.S. PATENT DOCUMENTS

| | | | | |
|---|---|---|---|---|
| 2,192,082 | A | 2/1940 | Hunicke | |
| 3,117,696 | A | 1/1964 | Herman et al. | |
| 3,144,966 | A | 8/1964 | Cook | |
| 3,166,221 | A | 1/1965 | Nielsen | |
| 3,236,418 | A | 2/1966 | Dalle et al. | |
| 3,272,387 | A | 9/1966 | Katz et al. | |
| 3,303,970 | A | 2/1967 | Breslau et al. | |
| 3,311,265 | A | 3/1967 | Creighton, Jr. et al. | |
| 3,366,290 | A | 1/1968 | Mojonnier et al. | |
| 3,575,319 | A | 4/1971 | Safianoff | |
| 3,587,982 | A | 6/1971 | Campbell | |
| 3,603,487 | A | 9/1971 | Cook | |
| 3,704,812 | A | 12/1972 | Marand | |
| 3,813,011 | A | 5/1974 | Harrison et al. | |
| 4,014,463 | A | 3/1977 | Hermann | |
| 4,040,420 | A | 8/1977 | Speer | |
| 4,159,079 | A | 6/1979 | Phillips, Jr. | |
| 4,261,481 | A | 4/1981 | Speer | |
| 4,515,296 | A | 5/1985 | Surdilla | |
| 4,752,020 | A | 6/1988 | Grueter et al. | |
| 4,773,562 | A | 9/1988 | Gueret | |
| 4,826,054 | A | 5/1989 | Frutin | |
| 4,880,143 | A | 11/1989 | Murray et al. | |
| 4,893,729 | A * | 1/1990 | Iggulden et al. | 222/42 |
| 4,958,750 | A | 9/1990 | Palmert et al. | |
| 5,005,736 | A | 4/1991 | Portas | |

(Continued)

FOREIGN PATENT DOCUMENTS

EP 1136388 A2 9/2001

OTHER PUBLICATIONS

Loctite Consumer Retail Products/Product Detail, Power Grab Construction Adhesives, 2 pages, Aug. 2004, at http://www.loctiteproducts.com/products/detail.as?catid=45&subid=113&plid=474.

(Continued)

*Primary Examiner*—Lien T Ngo
(74) *Attorney, Agent, or Firm*—Fay Sharpe LLP

(57) ABSTRACT

A multi-component dispenser is disclosed which can dispense reactive components in predetermined proportions. The dispenser also combines and mixes the components prior to their dispensing. In a particular version, the multi-component dispenser uses a single valve to simultaneously dispense multiple flowable components.

30 Claims, 10 Drawing Sheets

U.S. PATENT DOCUMENTS

| | | | | |
|---|---|---|---|---|
| 5,009,342 | A | 4/1991 | Lawrence et al. | |
| 5,040,705 | A | 8/1991 | Snell | |
| 5,064,098 | A | 11/1991 | Hutter, III et al. | |
| 5,092,492 | A | 3/1992 | Centea | |
| 5,203,839 | A | 4/1993 | Skaggs | |
| 5,224,629 | A | 7/1993 | Hsich | |
| 5,244,120 | A | 9/1993 | O'Meara | |
| 5,269,441 | A | 12/1993 | O'Meara | |
| 5,385,270 | A | 1/1995 | Cataneo et al. | |
| 5,386,928 | A | 2/1995 | Blette | |
| 5,405,051 | A | 4/1995 | Miskell | |
| 5,431,303 | A | 7/1995 | Miskell | |
| 5,431,307 | A | 7/1995 | Brown et al. | |
| 5,526,957 | A | 6/1996 | Brown et al. | |
| 5,568,883 | A | 10/1996 | Cataneo et al. | |
| 5,634,571 | A | 6/1997 | Cataneo et al. | |
| 5,893,486 | A | 4/1999 | Wasmire | |
| 5,897,539 | A * | 4/1999 | Elliesen et al. | 604/289 |
| 5,901,883 | A | 5/1999 | Ritsche | |
| 5,944,226 | A * | 8/1999 | Schiltz et al. | 222/137 |
| 6,012,462 | A | 1/2000 | Schmittou | |
| 6,305,578 | B1 * | 10/2001 | Hildebrandt et al. | 222/135 |
| 6,308,863 | B1 | 10/2001 | Harman | |
| 6,340,103 | B1 | 1/2002 | Scheindel et al. | |
| 6,343,718 | B1 | 2/2002 | Montenieri et al. | |
| 6,422,427 | B2 | 7/2002 | Brown et al. | |
| 6,474,510 | B2 | 11/2002 | Frutin | |
| 6,685,064 | B2 | 2/2004 | Frutin | |
| 2002/0130141 | A1 | 9/2002 | Gardos | |
| 2003/0071081 | A1 | 4/2003 | Lilienthal | |
| 2003/0075571 | A1 | 4/2003 | Thompson et al. | |
| 2004/0065691 | A1 | 4/2004 | Weiperth | |
| 2004/0188465 | A1 | 9/2004 | Timmerman et al. | |
| 2004/0195266 | A1 | 10/2004 | Hosozawa | |
| 2004/0251275 | A1 | 12/2004 | Sams et al. | |

OTHER PUBLICATIONS

LePage Products, Loctite Power Grab May Make Hammers Obsolete, 2 pages, Aug. 2004, at http://www.lepageproducts.com/detail.asp?PID=292.

Lindal Dual Action Power Can, Lindal Goup, at www.lindalgroup.com.

Lindal Group, Dispensing Systems, Nov. 2004, at http://www.lindalgroup.com/en.product.php?id=78.

* cited by examiner

DUAL CHAMBER PISTON PRESSURE PACK DISPENSER SYSTEM

FIELD OF THE INVENTION

The present invention relates to the art of liquid dispensers and, more particularly, to an improved dual chamber dispenser which serves to accurately and simultaneously dispense two or more liquids.

The present invention finds particular utility in connection with the dispensing of fluids and other flowable materials which undergo reaction upon mixing or contact with each other.

BACKGROUND OF THE INVENTION

Certain fluid products are best stored as two separate components to be mixed in selected proportions at the time of use. Such products include epoxy type glues, some foaming materials, other adhesive systems and the like. In the past, certain products have been sold as consumer products utilizing dual syringes requiring the consumer to hold the syringe and manually depress a dual piston interconnected plunger to dispense two reactants that upon reaction, form the product. The product was generally not mixed and had to be mixed by hand and applied thereafter.

Although satisfactory in many respects, manual mixing introduces a variety of variables into the reaction and resulting characteristics of the end product. Certain users of the product may undermix the reactants thereby leading to insufficient reaction or curing between the components. Undermixing can occur by either not mixing the components for a sufficient period of time, or from insufficient blending between the components. Furthermore, it is undesirable to mix the components due to the potential for the introduction of contaminants into the product. Moreover, mixing prior to actual application of the product invariably results in waste of at least a portion of the product.

Accordingly, there is a need for a system adapted for dispensing a multi-component reactive product, which does not require manual mixing by the end user.

Additionally, multi-component reactive systems often require administration of the components in unequal proportions. For example, in a two component system, it is often necessary that the components be administered together at a ratio of 1:2 or 3:2 instead of a 1:1 ratio. Although an end user could most likely dispense each respective component in the desired proportion, such obligation further complicates use of a multi-component system, thereby rendering the system less desirable by consumers. Furthermore, manual dispensing of each component in a particular amount, different from the amount of the other component, increases the likelihood of errors in dispensing and thus, results in the administration of incorrect ratios of components.

Accordingly, there is a need for a system adapted for accurately dispensing the components of a multi-component product, which does not require manual measurement of proportions of each component while dispensing.

Furthermore, multi-component reactive systems can utilize components that exhibit different flow characteristics, such as viscosity. Attempting to accurately dispense such components, particularly concurrently with one another, is difficult if one component has a relatively low viscosity and thus offers minimal resistance to flow, and another component has a higher viscosity thereby causing that material to exhibit much greater resistance to flow.

Accordingly, there is a need for a system adapted to accurately dispense, and particularly simultaneously dispense, multiple components of a multi-component product, in which each component exhibits a different viscosity or other flow characteristic.

SUMMARY OF THE INVENTION

In accordance with the present invention, a multi-chamber dispenser is provided by which the foregoing and other problems and disadvantages encountered in connection with the application of two or more fluids, are minimized or overcome.

In a first aspect, the present invention provides a dispenser adapted for simultaneously dispensing and mixing at least two flowable components. The dispenser includes at least two containers, each for housing a respective flowable component. Each container defines an interior hollow region and a flow-governing aperture. The dispenser also includes a single valve mixing assembly. The assembly includes a body defining at least two flow passages, each passage extending between an inlet and a valve receiving region. The mixing assembly also defines an exit port. The mixing assembly is aligned with, and non-displaceable with respect to, the containers such that a respective inlet is adjacent to an aperture defined in a corresponding container. The mixing assembly further includes a valve member disposed in the valve receiving region and positionable between an open state in which flow communication is established between each flow passage and the exit port, and a closed state in which flow communication is blocked between each flow passage and the exit port.

In another aspect, the present invention provides a multi-chamber dispenser comprising a collection of chambers. Each chamber has a first end, a second end opposite from the first end, and a chamber wall extending between the first and second ends. The second end defines an aperture. Each chamber defines an interior hollow region and each chamber includes a piston slidably disposed in the interior hollow region and apportioning the hollow region into a first region proximate the first end, and a second region proximate the second end. The dispenser also comprises a flow body defining a collection of inlet ports. Each inlet port is in flow communication with a corresponding aperture defined in a respective chamber. The flow body further defines an exit port and valve receiving region disposed between and in flow communication with each of the inlet ports and the exit port. The dispenser also comprises a single valve member slidably disposed in the valve receiving region. The valve member includes an outwardly extending trigger member whereby upon displacement of the trigger member, the valve member is directly displaced between an open position and a closed position.

In still another aspect, the present invention provides a dual chamber dispenser comprising a first chamber having a first end, a second end opposite from the first end, and a chamber wall extending between the first and second ends. The first chamber defines an interior hollow region, and the second end defines a flow aperture. The dispenser also comprises a second chamber having a first end, a second end opposite from the first end, and a chamber wall extending between the first and second ends. The second chamber defines an interior hollow region. The second end defines a flow aperture. The dispenser also comprises a first piston slidably disposed in the interior hollow region defined in the first chamber and sealingly contacting the chamber wall of the first chamber. The piston defines a first face and an oppositely directed second face. The piston divides the interior hollow region of the first chamber into a gas region defined between the first end of the first chamber and the first face of the piston, and a flowable material region defined between the second end of the first chamber and the second face of the piston. The dispenser also comprises a second piston slidably disposed in the interior hollow region defined in the second chamber and sealingly contacting the chamber wall of the second chamber. The piston defines a first face and an oppositely directed second face. The piston divides the interior hollow region of the second chamber into a gas region defined between the first end of the second chamber and the first face of the piston, and a flowable material region defined between the second end of the second chamber and the second face of the piston. The dispenser also comprises a mixing body disposed adjacent to the second ends of each of the first and second chambers and non-displaceable with respect to the first and second chambers. The mixing body defines (i) a valve receiving region, (ii) a first flow passage extending between the flow aperture defined in the first chamber and the valve receiving region, (iii) a second flow passage extending between the flow aperture defined in the second chamber and the valve receiving region, and (iv) an exit port in flow communication with the valve receiving region. The dispenser further comprises a linearly positionable, non-rotatable valve member slidably disposed within the valve receiving region. The valve member includes a trigger projection extending outwardly from the first and second chambers. The valve member is selectively positionable between (a) a first open position in which flow communication is established between (i) the first flow passage and the exit port, and (ii) the second flow passage and the exit port, and (b) a closed position in which flow communication is blocked between (i) the first flow passage and the exit port, and (ii) the second flow passage and the exit port.

In still a further aspect, the present invention provides a dispenser comprising a first chamber having a first end, a second opposite end, and a chamber wall extending therebetween. The first chamber defines an aperture at the first end. The dispenser also comprises a second chamber having a first end, a second opposite end, and a chamber wall extending therebetween. The second chamber defines an aperture at the first end of the second chamber. The dispenser further comprises a mixing assembly positioned adjacent the first ends of the first and second chambers. The mixing assembly defines (i) a valve receiving region, (ii) a first flow channel extending between the aperture defined at the first end of the first chamber and the valve receiving region, and (iii) a second flow channel extending between the aperture defined at the first end of the second chamber and the valve receiving region. The dispenser further comprises a single valve member disposed at least partially within the valve receiving region defined in the mixing assembly. The member is positionable between an open position and a closed position. The member defines a distal end which is exposed to both the first flow channel and the second flow channel upon the member being positioned to the open position.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENTS

The present invention provides a dispenser adapted for accurately dispensing in particular proportions, two or more components and mixing the components prior to their dispensing. In a preferred embodiment, the dispenser is tailored for dispensing two components of an adhesive system from separate chambers. Each chamber is pressurized. Each chamber includes a continuous side wall, two opposite ends with a dispensing valve located in one of the ends. A piston is contained within each chamber separating a pressurized gas volume on one side of the piston and a product volume on the other side of the piston. When the dispensing valve is opened such as by tilting or depressing the valve stem, the pressurized gas forces the piston outward, thereby dispensing product through the dispensing valve. The chambers are preferably rigidly interconnected and can be secured to one another. The valves closing the ends of the chambers communicate with a mixing chamber which in turn communicates with a dispensing nozzle. The valves are preferably interconnected so that opening one valve simultaneously opens the second valve the same amount. In certain versions described herein, a single valve can be used instead of multiple valves.

The preferred embodiment dispenser also can be configured to dispense particular components in particular proportions, and dispense components that exhibit physical properties different from one another. For example, such differences might be with regard to viscosity, flow characteristics, or effects exhibited as a result of being at certain temperatures or undergoing particular temperature changes. Specifically, the fluid components of a two component adhesive system may differ in viscosity. Moreover, the differences in viscosity may not be linearly related to one another over varying temperature. The differences in viscosity and the ratio at which the components are to be combined are addressed by sizing the orifice through which the individual components are dispensed through the dispensing valve, sizing the relative cross sectional areas of the two chambers, and selecting appropriate pressures and gas mixes for the propellants used in the two chambers. Thus, if the components are to be mixed at a ratio of 1:1, the cylinders may be the same size and the difference in the viscosity may be addressed through adjusting propellant mix. If the components are to be mixed in a ratio of 3:2, one cylinder may have a cross sectional area of 1.5 times the other cylinder, the valve may have a similar ratio in cross sectional or orifice area and viscosity differences addressed through propellant mix in the two chambers. The components of the adhesive are mixed in a mixing chamber and, possibly, further mixed in a nozzle having internal mixing vanes.

Figure 1:
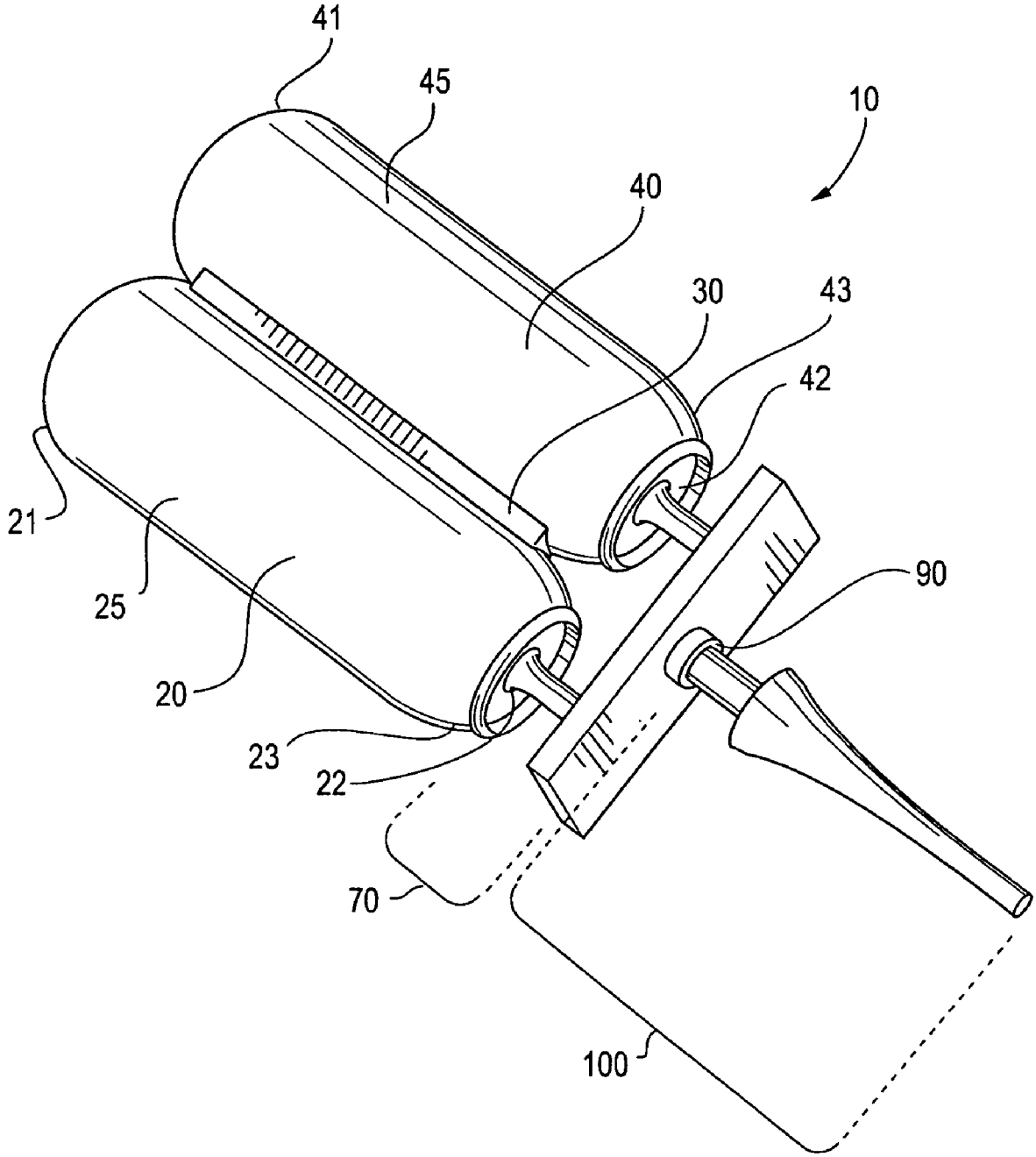
FIG. 1 is a perspective view of a preferred embodiment dispenser according to the present invention.

Referring now in greater detail to the drawings wherein the showings are for the purpose of illustrating preferred embodiments of the invention and not for the purpose of limiting the invention, specifically, FIG. 1 illustrates a first preferred embodiment dispenser 10 according to the present invention. The dispenser 10 comprises a first chamber 20 and a second chamber 40. The first chamber 20 defines a first end 21, a second opposite end 23, and a chamber wall 25 extending between the two ends. Similarly, the second chamber 40 defines a first end 41, a second opposite end 43, and a chamber wall 45 extending between the two ends. Each of the chambers defines an interior hollow region. The first and second chambers are preferably coupled or otherwise affixed to one another by a coupler 30 which generally extends along the length of each of the first and second chambers 20,40. The first chamber 20 includes an aperture 22. Similarly, the second chamber 40 includes an aperture 42. Specifically, the aperture 22 is defined in the second end 23 of chamber 20. And, the aperture 42 is defined in the second end 43 of chamber 40. Engaged along the apertured end of the first and second chambers is a mixing assembly 70. The assembly 70 is in flow communication with a valve 90. And, positioned along the distal end of the valve 90 is a nozzle 100. The mixing assembly 70, the valve 90, and the nozzle 100 are described in greater detail herein.

Figure 2:
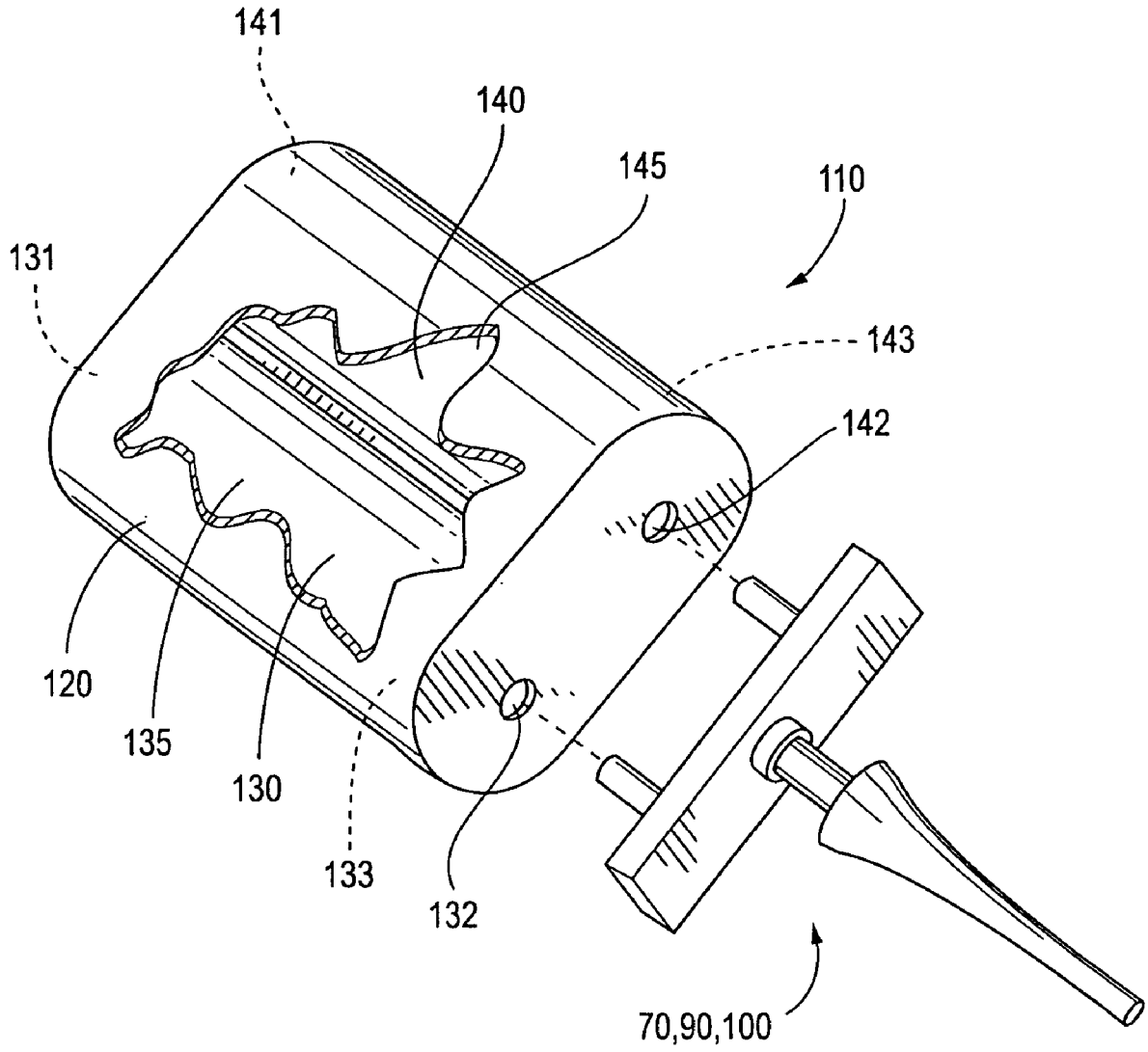
FIG. 2 is a partial sectional perspective view of another preferred embodiment dispenser according to the present invention.

FIG. 2 illustrates an alternate preferred embodiment dispenser 110 according to the present invention. The dispenser 110 comprises a canister 120 which defines a first chamber 130 and a second chamber 140 within the interior of the canister 120. The first chamber 130 defines a first end 131, a second opposite end 133, and a chamber wall 135 extending between the two ends. Similarly, the second chamber 140 defines a first end 141, a second opposite end 143, and a chamber wall 145 extending between the two ends. Each of the chambers and canister includes an aperture such as first chamber aperture 132 and a second chamber aperture 142. Instead of the canister 120 defining two or more chambers, the canister can define a generally hollow interior adapted to receive two or more containers which can serve as or otherwise provide chambers. The apertured end of the canister 120 is adapted to receive the mixing assembly 70, preferably in association with the valve 90 and the nozzle 100.

The present invention also contemplates that instead of a single valve, such as valve 90, located proximate the exit port of a mixing region, one or more valves could be utilized upstream of the mixing region, such as for example proximate flow apertures 22 and 42 illustrated in FIG. 1, or apertures 132 and 142 as depicted in FIG. 2. Utilizing a collection of valves upstream of the mixing region can be advantageous in that material flow is controlled with respect to its entry into the mixing region as opposed to its exit from the mixing region.

Although each of the chambers used in the preferred embodiment dispensers is cylindrical, the present invention includes the use of other shapes and configurations. For example, it is contemplated to use a chamber having a square or polygonal cross section when taken along a plane generally perpendicular to the longitudinal axis of the chamber. Each chamber is adapted to contain and maintain an internal pressure greater than atmospheric. Accordingly, the chambers are constructed accordingly and as described in greater detail herein. The chambers can be formed from a wide array of materials however, aluminum, steel, or various alloys thereof are contemplated.

Figure 3:
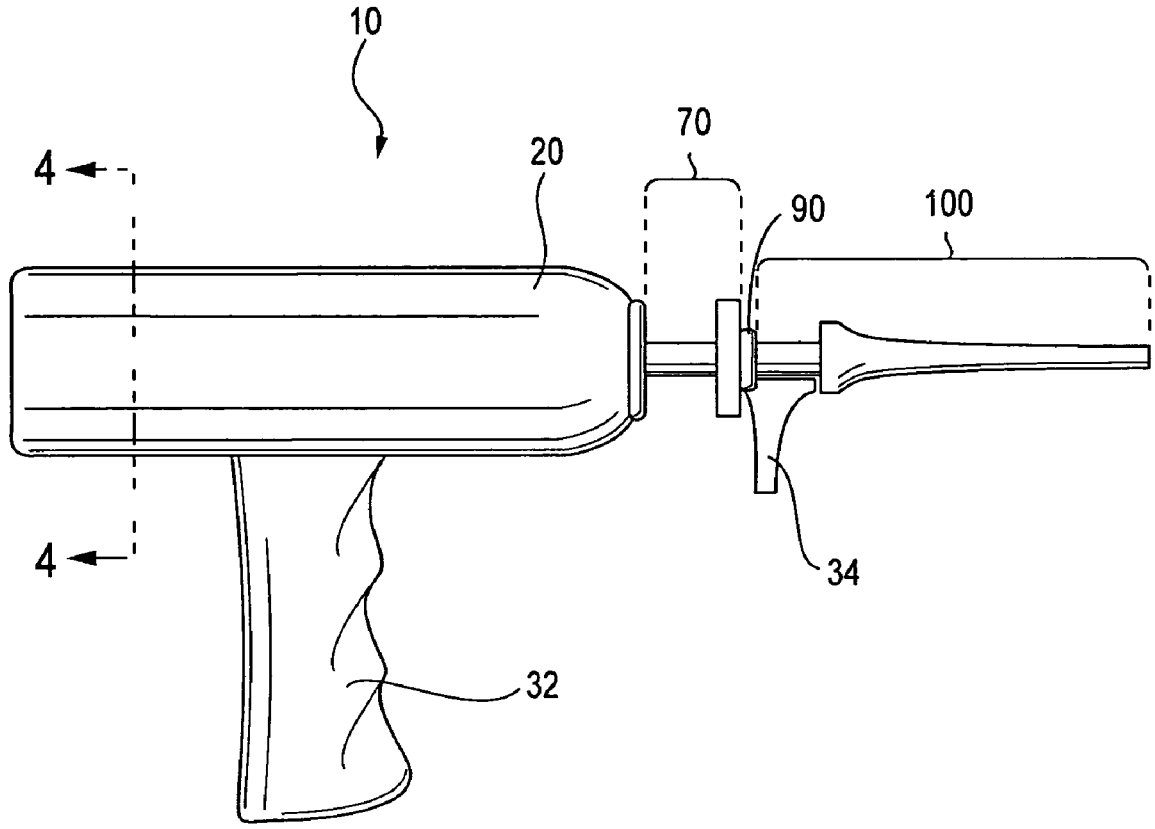
FIG. 3 is a side elevational view of the preferred embodiment dispenser depicted in FIG. 1.

FIG. 3 is a side elevational view of the first preferred embodiment dispenser 10 including the use of an optional handle 32 and an optional trigger member 34. It will be appreciated that these components are optional, however, generally, their use is preferred. The handle 32 generally extends at right angles from the longitudinal axes of the chambers. The handle can be formed from nearly any suitable material, such as for example, metal, plastic, or composites thereof. The trigger member 34 also preferably extends at right angles to the longitudinal axes of the chambers, and so is generally oriented parallel to the handle 32. The trigger member 34 can be engaged with a valve or dispensing component in the mixing assembly 70 as described in greater detail herein. The trigger member is preferably formed from a material similar to that used in forming the handle 32, e.g. metal, plastic, or composites thereof. As will be appreciated, in the event that the optional handle 32 and trigger member 34 are used, they are spaced apart a distance suitable for gripping the handle 32 while contacting the trigger member 34 with one's index finger. The present invention also includes the use of one of the handle member 32 and the trigger member 34, without the other.

Figure 4:
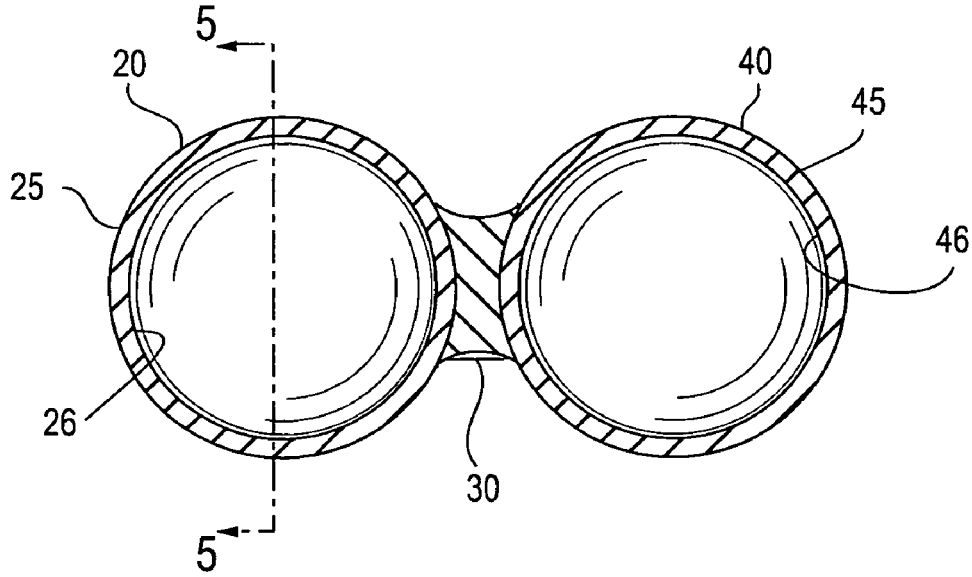
FIG. 4 is a cross-sectional view of a portion of the preferred embodiment dispenser taken across line 4-4 shown in FIG. 3.

FIG. 4 is a cross-sectional view taken across lines 4-4 in FIG. 3. FIG. 4 illustrates the first and second chambers 20 and 40 and the coupler 30 securing the chambers to one another. The chamber wall 25 defines an interior arcuate surface 26 that forms the interior region of chamber 20. The chamber wall 45 defines an interior arcuate surface 46 that forms the interior region of chamber 40. Each of the interior surfaces 26 and 46 are preferably finished and adapted to form a seal with a moveable piston slidably positioned within each chamber. And so, upon assembly, the piston sealingly contacts the interior surface of the hollow region in the chamber.

Figure 5:
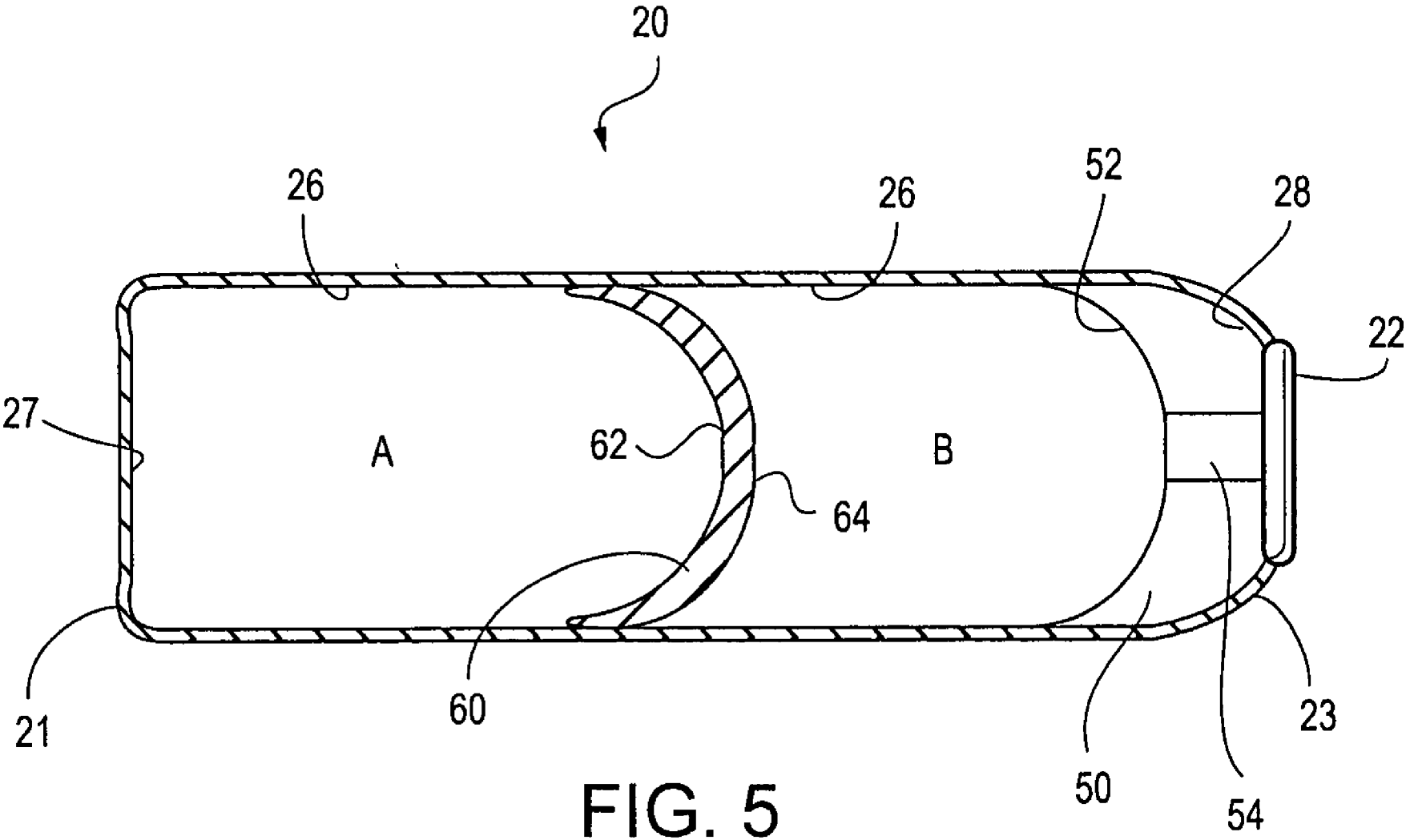
FIG. 5 is a schematic cross-sectional view of a portion of the first chamber taken across line 5-5 in FIG. 4 of the preferred embodiment dispenser according to the present invention.

FIG. 5 is a schematic cross-sectional view of a chamber such as the first chamber 20 taken across line 5-5 in FIG. 4. Disposed within the interior of the chamber is a piston 60 which is slidable therein. The piston can generally be displaced between one end or region of the chamber 20 and an opposite or distally located region of the chamber 20. Specifically, an interior first end face 27 is defined at the first end 21, and an interior second end face 28 opposite from the first face 27, are defined at the ends of the chamber and between which the interior arcuate surface 26 extends. The piston 60 defines a front face 64 and a rear oppositely directed face 62. The piston 60 is slidably disposed between these ends and divides the interior region of the chamber 20 into two portions or regions A and B. Portion A is defined between the first end face 27, the rear piston face 62, and the arcuate surface 26. Portion B is defined between the second end face 28, the front piston face 64, and the arcuate surface 26. It will be understood that as the piston 60 is displaced toward either end 21 or 23 of the chamber, the volume of one portion will increase and the volume of the other portion will decrease accordingly. Typically, a component to be dispensed resides in portion B and a pressurized gas resides in portion A. A receiver body 50 is optionally disposed at one end of the chamber 20 and preferably adjacent the aperture 22. The receiver body 50 assists in directing flowable component material in portion B toward and through the aperture 22 defined at the end 23 of the chamber. The receiver body 50 preferably defines a flow conduit 54 that extends through the thickness of the body 50 and provides flow communication between portion B and the aperture 22. Preferably, the body 50 also defines a receiving face surface 52 that exhibits a curvature or other configuration so as to match the curvature or geometry of the front face 64 of the piston 60.

Figure 6:
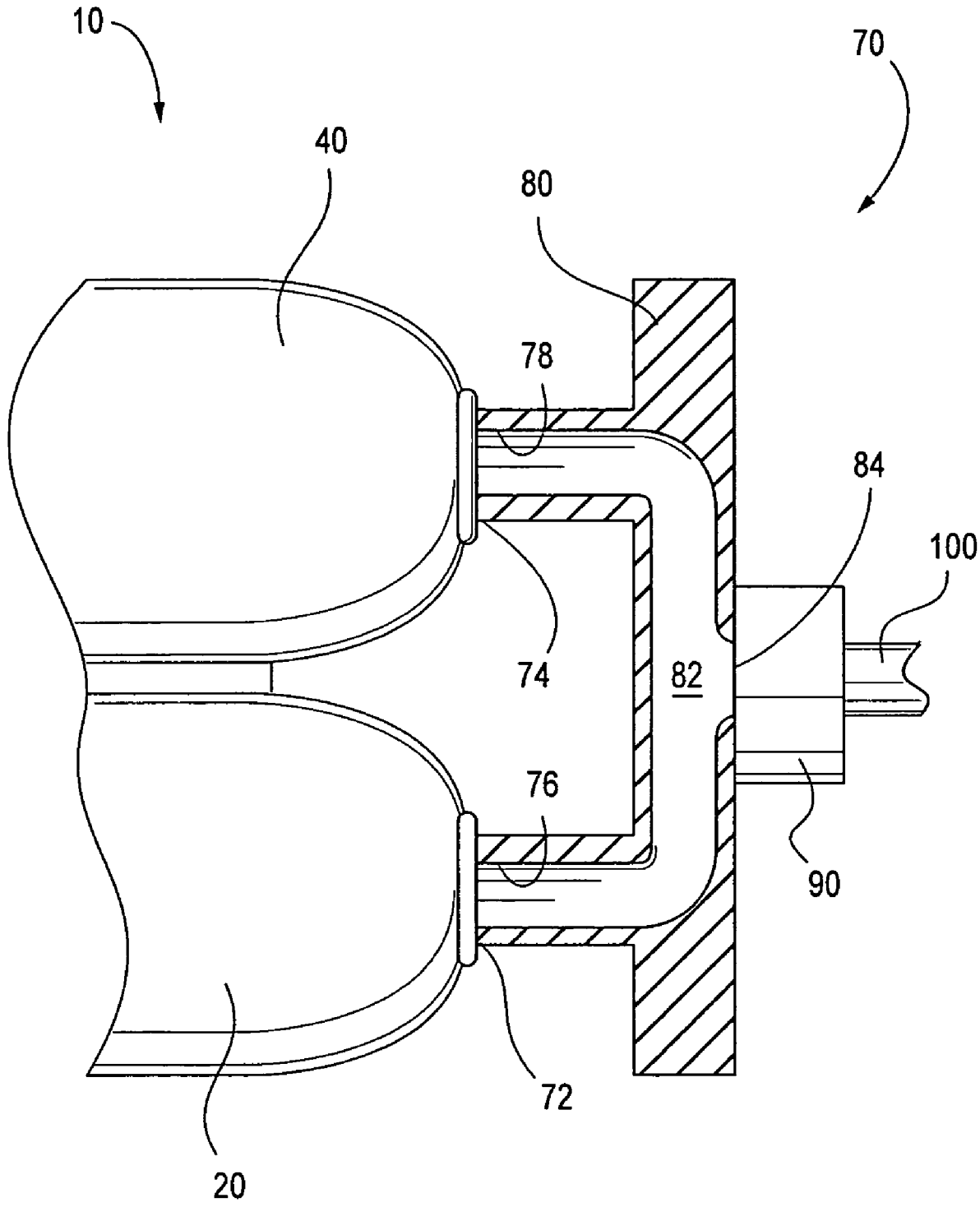
FIG. 6 is a partial sectional schematic view of a portion of the preferred embodiment dispenser according to the present invention.

FIG. 6 is a schematic partial cross-sectional view of the mixing assembly 70 or flow body engaged with the first and second chambers 20,40 of the dispenser 10. The mixing assembly 70 includes a body 80 which defines a first inlet 72 and a second inlet 74. The body also defines an exit 84 through which material may flow into the valve 90 and eventually to nozzle 100. The body 80 defines a first passage 76 generally extending from the first inlet 72 to a mixing region 82 defined proximate the exit 84. Similarly, the body 80 defines a second passage 78 extending from the second inlet 74 to the mixing region 82. It will be appreciated that FIG. 6 is a schematic illustration. In practice, the mixing region 82 is generally larger and defines a greater interior volume than the passages 76 and 78. In addition, the interior surfaces defining the passages 76 and 78, and the mixing region 82, are preferably finished and devoid of regions which can trap material flowing from the chambers to the exit 84. The mixing region can include one or more internal mixing vanes to promote component mixing within that region.

Figure 7:
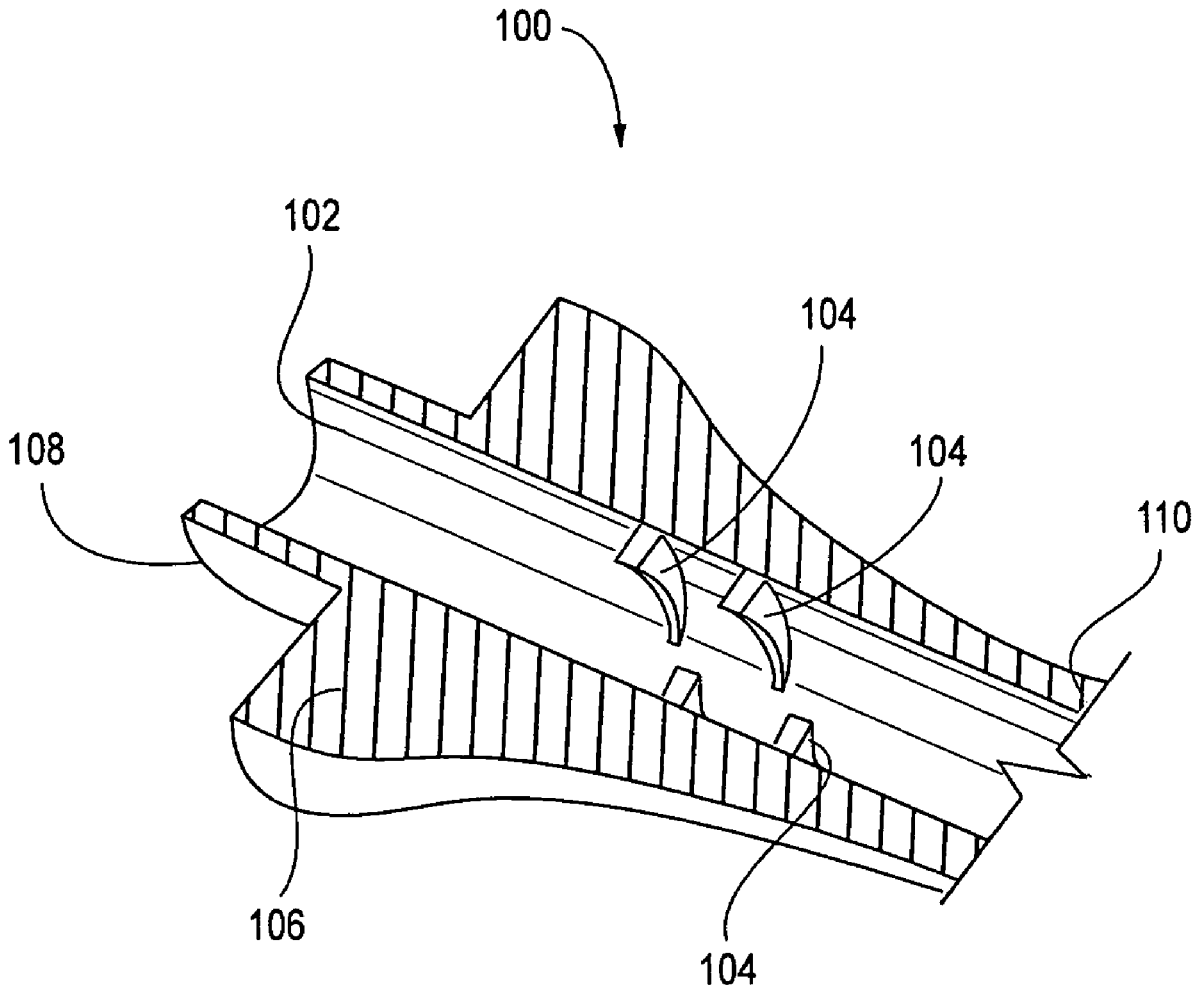
FIG. 7 is a schematic partial cross section of a preferred embodiment flow nozzle used in the dispenser of the present invention.

FIG. 7 is a cross section of the nozzle 100 illustrating a preferred interior configuration. Specifically, nozzle 100 includes a nozzle body 106 that defines a first end 108 which engages with an exit port of a mixing assembly, such as 70, an opposite distal end 110, and a flow conduit 102 extending between the first end 108 and the distal end 110. In a preferred version of the nozzle 100, a plurality of mixing vanes 104 are provided along the flow conduit 102. The mixing vanes increase turbulence and thus mixing of a flowable material traveling through the conduit 102.

FIGS. 8-12 illustrate another preferred embodiment dispenser according to the present invention. In this other preferred embodiment, the dispenser uses a single valve assembly for simultaneously dispensing materials from two or more respective containers, simultaneously. The use of a single valve assembly enables a relatively simple and efficient assembly that is economical to manufacture and easy to assemble and use.

Figure 8:
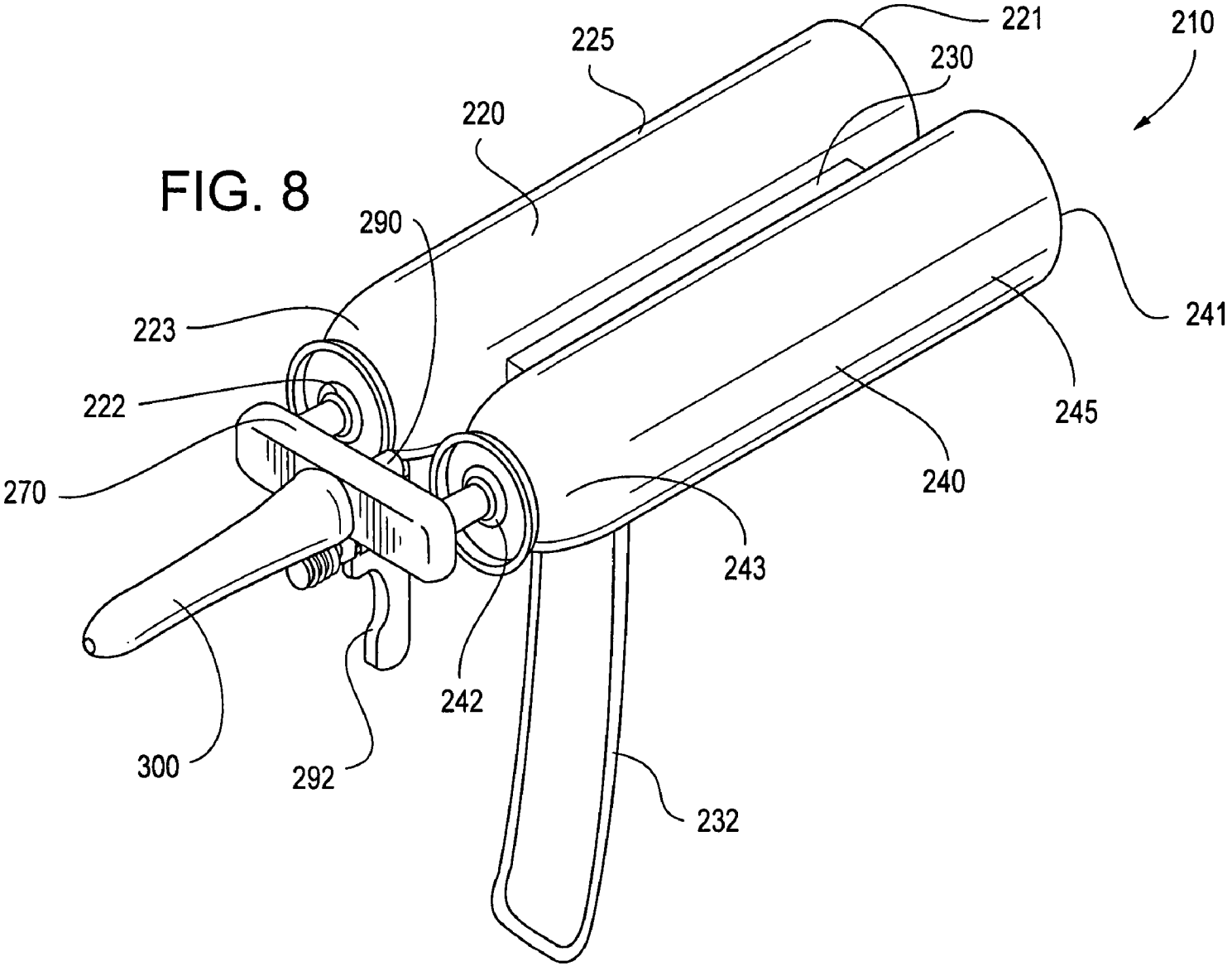
FIG. 8 is a schematic view of yet another preferred embodiment dispenser according to the present invention.
Figure 9:
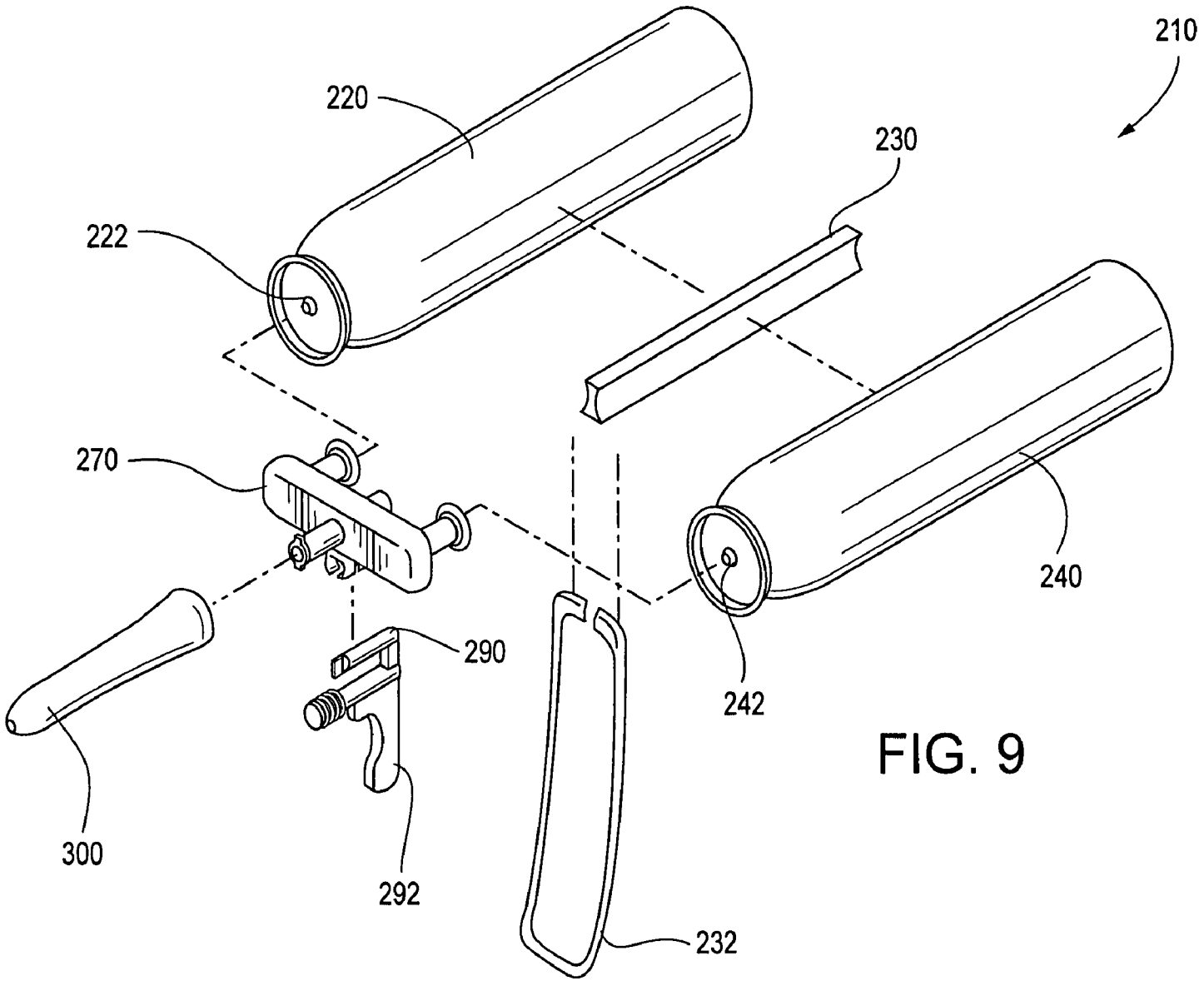
FIG. 9 is an exploded view of the preferred embodiment dispenser illustrated in FIG. 8.

More specifically, FIGS. 8 and 9 illustrate a first preferred embodiment dispenser 210 according to the present invention. The dispenser 210 comprises a first chamber 220 and a second chamber 240. The first chamber 220 defines a first end 221, a second opposite end 223, and a chamber wall 225 extending between the two ends. Similarly, the second chamber 240 defines a first end 241, a second opposite end 243, and a chamber wall 245 extending between the two ends. Each of the chambers defines an interior hollow region. The first and second chambers are preferably coupled or otherwise affixed to one another by a coupler 230 which generally extends along the length of each of the first and second chambers 220, 240. The first chamber 220 includes an aperture 222. Similarly, the second chamber 240 includes an aperture 242. Specifically, the aperture 222 is defined in the second end 223 of chamber 220. And, the aperture 242 is defined in the second end 243 of chamber 240. The dispenser 210 also includes a handle 232. The handle 232 is optional and generally extends at right angles from the longitudinal axes of the chambers. The handle can be formed from nearly any suitable material, such as for example, metal, plastic, or composites thereof. Engaged along the apertured end of the first and second chambers is a mixing assembly 270 or flow body. The assembly 270 is in flow communication with a valve member 290. The valve member 290 is engaged with or can be integrally formed with a trigger 292. And, positioned along the distal end of the valve member 290 is a nozzle 300. The mixing assembly 270, the valve member 290, and the nozzle 300 are described in greater detail herein.

The present invention also contemplates that instead of a single valve, such as the use of valve member 290, located proximate the exit port of a mixing region, one or more valves could be utilized upstream of the mixing region, such as for example proximate flow apertures 222 and 242 illustrated in FIGS. 8 and 9. Utilizing a collection of valves upstream of the mixing region can be advantageous in that material flow can be controlled with respect to its entry into a mixing region as opposed to its exit from the mixing region. However, a significant feature of the dispenser 210 is that a single valve, i.e. valve member 290 positionable within the mixing assembly 270, is used without any valves upstream thereof. As compared to the previously described dispenser 10, the dispenser 210 is free of valves at the apertures 222 and 242 of the chambers 220 and 240. The use of a single valve in the dispenser 210 can lead to relatively low production costs and simplify manufacturing.

Although each of the chambers used in the preferred embodiment dispenser 210 is cylindrical, the present invention includes the use of other shapes and configurations. For example, it is contemplated to use a chamber having a square or polygonal cross section when taken along a plane generally perpendicular to the longitudinal axis of the chamber. Each chamber is adapted to contain and maintain an internal pressure greater than atmospheric. Accordingly, the chambers are constructed accordingly and as described in greater detail herein. The chambers can be formed from a wide array of materials however, aluminum, steel, or various alloys thereof are contemplated.

Figure 10:
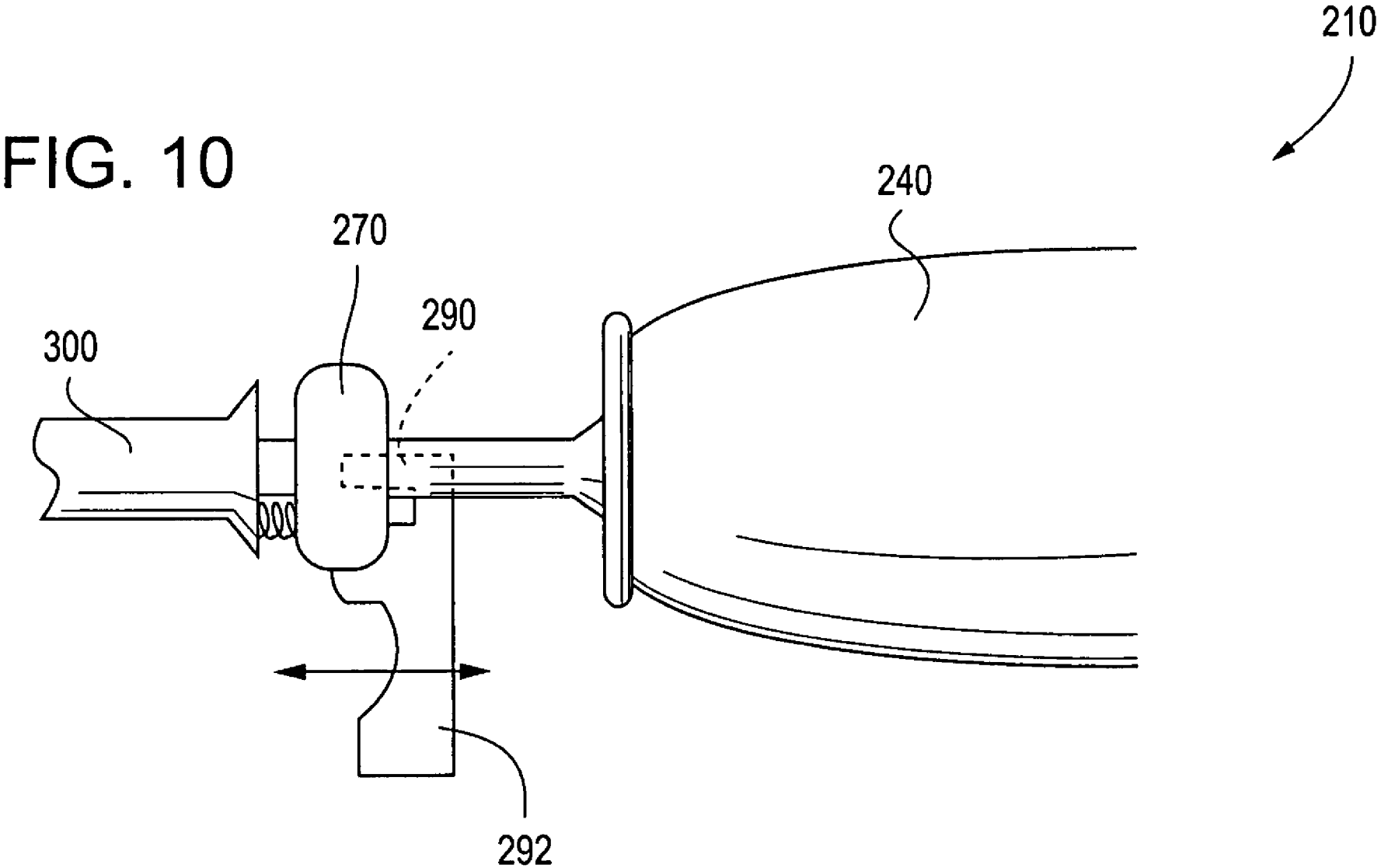
FIG. 10 is a partial side elevational view of a manifold and trigger assembly of the preferred embodiment dispenser illustrated in FIG. 8.

FIG. 10 is a side elevational view of the preferred embodiment dispenser 210 illustrating the use of the trigger member 292. The trigger member 292 preferably extends at right angles to the longitudinal axes of the chambers, such as chamber 240 and so is generally oriented parallel to the handle 232 (not shown). The trigger member 292 is preferably engaged with a valve or dispensing component in the mixing assembly 270 such as valve member 290 as described in greater detail herein. The trigger member is preferably formed from a material similar to that used in forming the handle 232, e.g. metal, plastic, or composites thereof. As will be appreciated, in the event that the optional handle 232 and trigger member 292 are used in conjunction with one another, they are spaced apart a distance suitable for gripping the handle 232 while contacting the trigger member 292 with one's index finger. The present invention also includes the use of one of the handle member 232 and the trigger member 292, without the other. Referring further to FIG. 10, the valve member 290 is displaced or otherwise moved within the mixing assembly 270 by moving the trigger 292 in the directions of the arrows. The trigger member 292 is engaged with, and preferably directly engaged with, the valve member 290 such that displacement of the trigger member causes concurrent, or substantially so, displacement of the valve member. A biasing member, such as a spring, can be engaged with the trigger member 292 or the valve member 290, to urge the member(s) 290, 292 to a desired position. For instance, a spring that is coupled to the trigger member 292, can be used to urge the valve member 290 to a normally closed position. This configuration is further described as follows.

Figure 11:
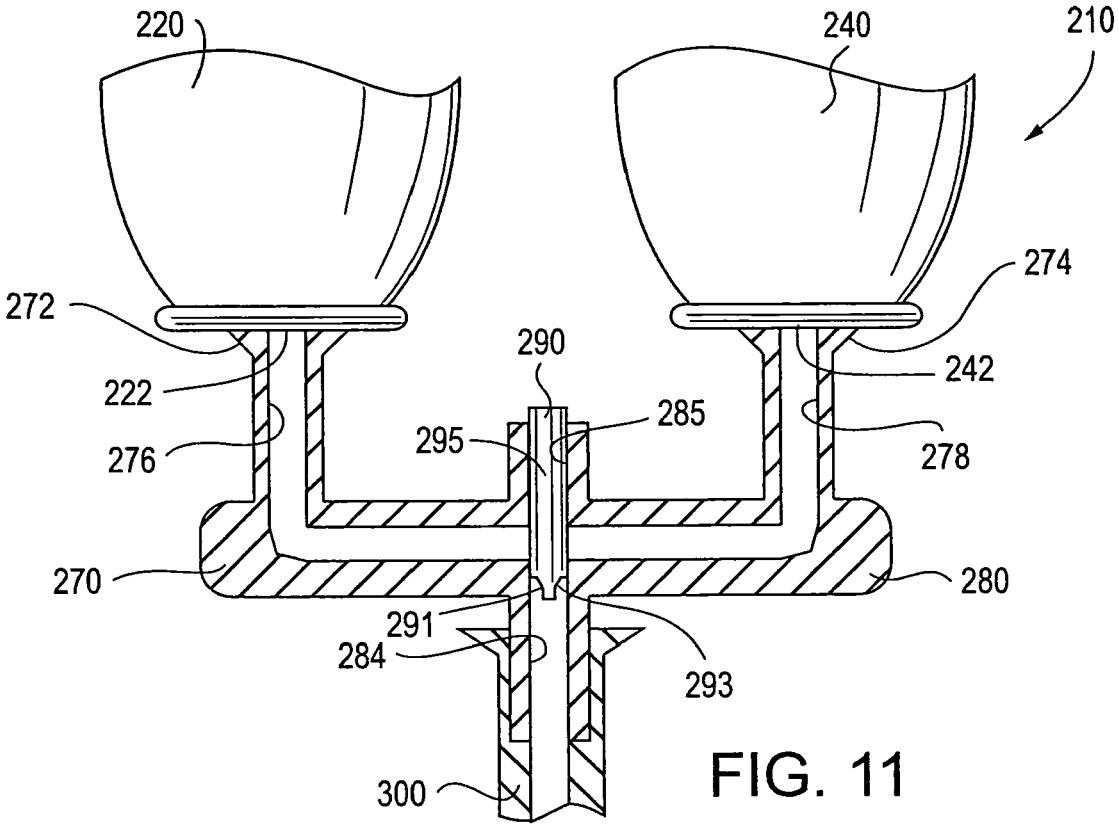
FIG. 11 is a partial cross-sectional view of a manifold illustrating a plunger assembly in a closed position in the preferred embodiment dispenser illustrated in FIG. 8.
Figure 12:
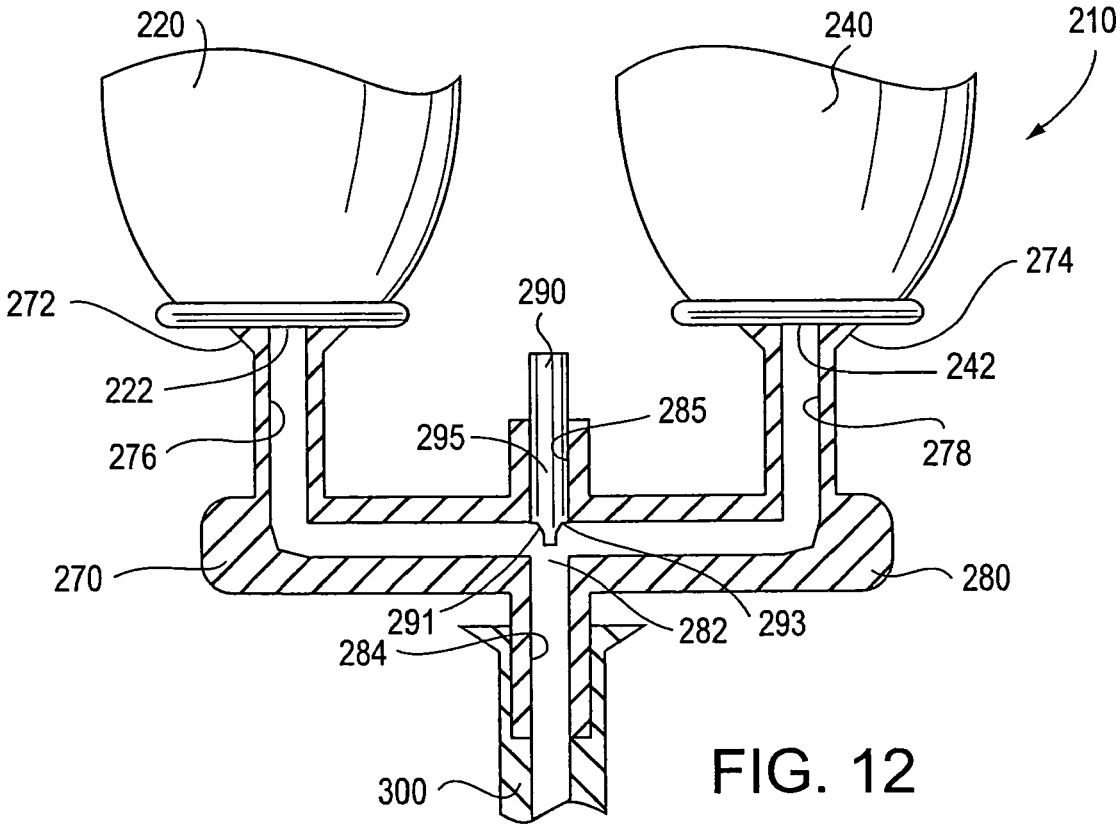
FIG. 12 is a partial cross-sectional view of the manifold illustrating the plunger assembly in an open position in the preferred embodiment dispenser shown in FIG. 8.

FIGS. 11 and 12 are each a schematic partial cross-sectional view of the mixing assembly 270 engaged with the first and second chambers 220, 240 of the dispenser 210. These views illustrate positioning the valve member 290 within the mixing assembly 270. The mixing assembly 270 includes a body 280 which defines a first inlet 272 and a second inlet 274. The body also defines an exit 284 through which material may flow past the valve member 290 and eventually to nozzle 300. The body 280 is positioned relative to the chambers 220 and 240 such that the body defines a first passage 276 generally extending from the first inlet 272 to a mixing region 282 (FIG. 12) defined proximate the exit 284. Similarly, the body 280 defines a second passage 278 extending from the second inlet 274 to the mixing region 282. The body 280 also defines a receiving region 285 adapted to sealingly receive the valve member 290. The receiving region 285 enables the valve member 290 to move or otherwise be displaced within the region 285. The geometry and configuration of the region 285 is preferably matched to the geometry and configuration of the valve member 290. For example, if the valve member 290 utilizes a circular cross section, then the cross-sectional shape of the opening of the region 285 is also circular. The opening of the region 285 is sized so as to accommodate displacement of the valve member 290 therein, yet retain a seal therebetween. If necessary, one or more sealing elements can be utilized in conjunction with the valve member 290 and the receiving region 285 to prevent or reduce leakage of material from that area. FIG. 11 illustrates the valve member 290 in a closed position such that material in either or both of the first and second passages 276 and 278 cannot flow or otherwise travel to the exit 284. FIG. 12 illustrates the valve member 290 in an open position such that material in the passages 276 and 278 can flow to the exit 284, and preferably through the mixing region 282. It will be appreciated that FIGS. 11 and 12 are schematic illustrations. In practice, the mixing region 282 can be generally larger and define a greater interior volume than the passages 276 and 278. In addition, the interior surfaces defining the passages 276 and 278, and the mixing region 282, are preferably finished and devoid of regions which can trap material flowing from the chambers to the exit 284. The mixing region can include one or more internal mixing vanes to promote component mixing within that region.

FIGS. 11 and 12 also illustrate a preferred version of the valve member 290. In this preferred version, the valve component defines two deflection surfaces 291 and 293 at a distal end 295 of the member 290. The deflection surfaces 291 and 293 serve to deflect or otherwise guide material in a respective passage 276 to 278 to flow from that passage past the distal end 295 of the valve member 290, and into the mixing region 285. The deflection surfaces 291 and 293 can be in a variety of forms and configurations such as flat surfaces or concave surfaces. It is preferred that the surfaces 291 and 293 each be concave, so as to lessen the extent of energy loss as material flows past the valve member 290 and changes direction in its motion or flow path.

The various preferred embodiment dispensers described herein can utilize a number of different features. For example, the dispensers can utilize a mixing assembly or flow body that is generally affixed or secured to one or more of the chambers or containers, or the coupler joining those components. By such affixment, the mixing body is generally non-displaceable and rigid or fixed with respect to the containers. This is advantageous in that achieving a seal between these components is easier than if the mixing body were positionable or displaceable with respect to the containers.

Another feature of the preferred dispensers relates to the use of an integral valve member and trigger. Although integral is preferred, the present invention includes versions in which the valve member is directly engaged with and coupled to the trigger component. This configuration simplifies assembly and results in less costly manufacturing.

A further feature preferably exhibited by the dispensers relates to the valve member being slidably disposed in the valve receiving region defined in the mixing body. Preferably, the valve member is linearly positionable therein, and most preferably non-rotatable once disposed in the valve receiving region. Preventing the valve member from rotating within the receiving region promotes sealing around the member, simplifies assembly and overall manufacture. And, as previously noted, it is also preferred to provide oppositely directed, or angled, deflection surfaces at the distal tip of the valve member. In certain aspects, the deflection surfaces can each be concave.

Although the present invention dispensers include the use of multiple valves to govern the discharge or rate of discharge of one or more materials, it is the single valve version that is most preferred. The single valve dispensers are more easily manufactured, less expensive, and simpler to operate. Accordingly, widespread commercial appeal is anticipated.

Although the preferred embodiment dispensers have been described in terms of combining, mixing, and dispensing two reactants, each from a separate storage chamber, it will be understood that the present invention includes a dispenser adapted for dispensing three or more reactants or components.

As previously noted, the present invention dispensers can be configured to simultaneously dispense components from separate containers and in different, predetermined proportions. Therefore, in addition to dispensing different components at equal proportions, the dispenser can dispense components at different proportions. For example, for a two component dispenser, the dispenser can be tailored to dispense components in a wide range of proportions, such as from about 10:1 to about 1:10. The particular proportion of each component to be dispensed from its respective container or chamber can be governed by the cross sectional area of the flow passage through which the component flows toward the mixing region. Preferably, a flow governing aperture representing the smallest cross sectional area in the component's flow path is used to govern or control the degree of flow, and particularly, the degree of flow with respect to the other component.

For example, for a two component system in which components A and B are to be dispensed in a volumetric ratio of 2:3, flow governing apertures are used to limit or govern the amount or rate of flow of each component. The ratio of the cross sectional areas of the apertures defined by the flow governing apertures corresponds to the desired dispensing ratio of components. In the present example, the ratio of cross sectional area of the flow governing aperture A to the cross sectional area of the flow governing aperture B is 2:3.

Each flow governing aperture, or rather member defining that aperture, can be positioned anywhere in the flow path of a respective component between the component source and the mixing region. However, it is preferred that the flow governing aperture be disposed at or adjacent to the aperture for the component container or chamber, such as for instance, apertures 22 and 42 in FIG. 1, or apertures 222 and 242 in FIGS. 8 and 9.

Also, as previously noted, the present invention dispensers can be configured to simultaneously dispense components having different flow characteristics such as viscosity. That is, the present invention dispenser can be tailored to simultaneously dispense a first component having a relatively low viscosity, and thus offering minor resistance to flow, and a second component having a relatively high viscosity, and thus exhibiting a greater resistance to flow. As noted, each container or chamber housing a component includes a movable piston that defines a region for containing a pressurized gas. The higher the pressure of the gas, the greater the force exerted upon the movable piston. And so, a flowable component residing on the other side of the piston can be displaced at a faster rate from the container by increasing the pressure of the gas residing on the opposite side of the piston. Thus, components having different viscosities can be made to dispense at the same rate (assuming the dispensing ratio is 1:1) by using a gas at higher pressure in the chamber containing the higher viscosity component.

A wide range of pressures may be utilized in each chamber. The selection of the particular pressure or pressure range for the gas in each container will depend upon the viscosity of each component, the difference in the component viscosities, the temperature, and the ratio of the flow governing apertures through which the components are dispensed.

It is also contemplated that for a given gas pressure or range of pressures in a container, a specific force or range of forces exerted upon the piston face can be achieved by utilizing a piston having a face or exposed region with a predetermined cross sectional area. As will be appreciated by those skilled in the art, the force imparted upon the flowable material depends upon the pressure of the gas on the other side of the piston and the cross sectional area of the piston face which is exposed to the gas. Related to this aspect, the present invention includes the use of different sized containers or chambers.

While considerable emphasis has been placed herein on the structure of a preferred embodiment of the invention, it will be appreciated that many changes can be made in the preferred embodiment and that other embodiments can be made without departing from the principles of the invention. These and other changes in the preferred embodiment as well as other embodiments will be obvious and suggested to those skilled in the art from the disclosure herein, whereby the foregoing descriptive matter is to be interrupted merely as illustrative of the present invention and not as a limitation.

Having thus described the invention, it is so claimed:

1. A dispenser adapted for simultaneously dispensing and mixing at least two flowable components in predetermined dispensing proportions, the dispenser including:

at least a first container and a second container, said first container housing a first flowable component having a first viscosity and having a first interior hollow region of a first cross section and a first flow-governing aperture having a first aperture size, said second container housing a second flowable component reactive with the first flowable component having a second viscosity and having a second interior hollow region of a second cross section and a second flow-governing aperture having a second aperture size;

said first hollow region being pressurized by a first propellant charge of a first pressure and first gas mix, said second hollow region being pressurized by a second propellant charge of a second pressure and second gas mix;

a single valve mixing assembly, the assembly including a body defining at least two flow passages, each passage fluidly connecting an inlet to a single mixing region, the mixing assembly also defining a single exit port fluidly connected to the mixing region, the mixing assembly being aligned with, and non-displaceable with respect to, the containers such that a respective inlet is adjacent to an aperture defined in a corresponding container, the mixing assembly further including a single valve member disposed therein for linear movement between an open state in which the valve member is removed from the mixing region and flow communication is established between each flow passage and the exit port, and a closed state in which the valve member is disposed in the mixing region and flow communication is blocked between each flow passage and the exit port;

said predetermined dispensing proportions being established by the proportions of said first cross section to said second cross section, said first aperture size to said second aperture size, said first pressure to said second pressure, said first gas mix to said second gas mix and said first viscosity to said second viscosity; and, wherein the valve member defines a pair of deflection surfaces adapted positionable in the mixing region when flow communication is established and for contacting material flowing past the valve member when the member is in the open state.

2. The dispenser of claim 1 wherein the valve member includes a trigger projecting outward from the valve member.

3. The dispenser of claim 1, the dispenser further including:

a trigger member directly engaged with the valve member such that displacement of the trigger member causes concurrent, or substantially so, displacement of the valve member.

4. The dispenser of claim 1 wherein the valve member is non-rotatable with respect to the valve receiving region.

5. The dispenser of claim 1 wherein the deflection surfaces are each concave portions adjacent a free end of the valve member.

6. The dispenser of claim 1 further comprising:

a flow nozzle in communication with the exit port defined in the mixing assembly, the nozzle adapted to direct flowable material being dispensed from the dispenser.

7. The dispenser of claim 1 further comprising:

a linearly movable piston disposed in each container and adapted to sealingly contact an inner wall surface of each respective container that defines the interior hollow region.

8. The dispenser of claim 1 further comprising a handle affixed to at least one container.

9. A multi-chamber dispenser comprising:

plurality of chambers, each chamber having a first end, a second end opposite from the first end, and a chamber wall extending between the first and second ends, the second end defining an aperture, each chamber defining an interior hollow region, each chamber including a piston slidably disposed in the interior hollow region and apportioning the hollow region into a first region proximate the first end, and a second region proximate the second end;

a flow body defining a plurality of inlet ports, each inlet port in flow communication with a corresponding aperture defined in a respective chamber, the flow body further defining an exit port and a valve receiving region disposed between and in flow communication with each of the inlet ports and the exit port;

a single valve member slidably disposed in the valve receiving region, the valve member including an outwardly extending trigger member whereby upon displacement of the trigger member, the valve member is directly and linearly displaced between an open position and a closed position;

a first chamber housing a first flowable component having a first viscosity and having a first interior hollow region of a first cross section and a first flow-governing aperture having a first aperture size, a second chamber housing a second flowable component having a second viscosity and having a second interior hollow region of a second cross section and a second flow-governing aperture having a second aperture size;

said first hollow region being pressurized by a first propellant charge of a first pressure and first gas mix, said second hollow region being pressurized by a second propellant charge of a second pressure and second gas mix;

each said piston adapted to sealingly contact an inner wall surface of each respective chamber that defines;

predetermined dispensing proportions being established by the proportions of said first cross section to said second cross section, said first aperture size to said second aperture size, said first pressure to said second pressure, said first gas mix to said second gas mix and said first viscosity to said second viscosity; and, wherein the valve member defines a pair of deflection surfaces adjacent a mixing region and adapted for contacting and deflecting material flowing past the valve member when the member is in the open position.

10. The dispenser of claim 9 wherein the valve member is non-rotatable with respect to the valve receiving region.

11. The dispenser of claim 9 wherein the deflection surfaces are each concave.

12. The dispenser of claim 9 further comprising: a pressurized gas contained in the first region of at least one of the chambers.

13. The dispenser of claim 9 wherein the number of chambers of the plurality of chambers is 2.

14. The dispenser of claim 13 wherein the dispenser comprises a first chamber and a second chamber secured to the first chamber, the dispenser further comprising:

a first pressurized gas contained in the first region of the first chamber; and a second pressurized gas contained in the first region of the second chamber.

15. The dispenser of claim 13 further comprising:

a first reactive flowable component contained in the first region of the first chamber; and a second reactive flowable component contained in the second region of the second chamber.

16. The dispenser of claim 15 wherein the first reactive component and the second reactive component can react with each other to produce a reaction product.

17. The dispenser of claim 9 further comprising:

a flow nozzle disposed proximate the exit of the flow body, the nozzle defining an internal conduit extending through the nozzle.

18. The dispenser of claim 17 wherein the nozzle includes mixing vanes adapted to promote mixing of a flowable material undergoing displacement through the internal conduit of the nozzle.

19. A dual chamber dispenser comprising:

a first chamber having a first end, a second end opposite from the first end, and a chamber wall extending between the first and second ends, the first chamber defining an interior hollow region, the second end defining a flow aperture;

a second chamber having a first end, a second end opposite from the first end, and a chamber wall extending between the first and second ends, the second chamber defining an interior hollow region, the second end defining a flow aperture;

a first piston linearly slidably disposed in the interior hollow region defined in the first chamber, and sealingly contacting the chamber wall of the first chamber, the first piston defining a first face and an oppositely directed second face, the first piston dividing the interior hollow region of the first chamber into a gas region defined between the first end of the first chamber and the first face of the first piston, and a flowable material region defined between the second end of the first chamber and the second face of the first piston;

a second piston linearly slidably disposed in the interior hollow region defined in the second chamber, and sealingly contacting the chamber wall of the second chamber, the second piston defining a first face and an oppositely directed second face, the second piston dividing the interior hollow region of the second chamber into a gas region defined between the first end of the second chamber and the first face of the second piston, and a flowable material region defined between the second end of the second chamber and the second face of the second piston;

a mixing body disposed adjacent to the second ends of each of the first and second chambers and non-displaceable with respect to the first and second chambers, the mixing body defining (i) a valve receiving region, (ii) a first flow passage extending between the flow aperture defined in the first chamber and the valve receiving region, (iii) a second flow passage extending between the flow aperture defined in the second chamber and the valve receiving region, and (iv) an exit port in flow communication with the valve receiving region;

a non-rotatable valve member slidably disposed within the valve receiving region, the valve member including a trigger projection extending outwardly from the first and second chambers, the valve member being selectively and linearly positionable between (a) a first open position in which flow communication is simultaneously established between (i) the first flow passage and the exit port, and (ii) the second flow passage and the exit port, and (b) a closed position in which flow communication is blocked between (i) the first flow passage and the exit port, and (ii) the second flow passage and the exit port;

said first chamber housing a first flowable component having a first viscosity, said second chamber housing a second flowable component having a second viscosity reactive with the first flowable component;

said first gas region being pressurized by a first propellant charge of a first pressure and first gas mix, said second gas region being pressurized by a second propellant charge of a second pressure and second gas mix; and, wherein a distal tip of the valve member defines a pair of angle deflection surfaces adapted for contacting and deflecting material flowing past the valve member into an adjacent mixing region when the member is in the open position.

20. The dispenser of claim 19 wherein the deflection surfaces are each concave.

21. The dual chamber dispenser of claim 19 further comprising:

the first flowable component is contained in the flowable material region of the first chamber;

the second flowable component is contained in the flowable material region of the second chamber; and, the first and the second flowable components are mixed in the valve receiving region to form a reacting composition.

22. The dual chamber dispenser of claim 19 further comprising:

a flow nozzle disposed proximate the exit port defined in the mixing body and adapted to receive and direct material flowing therethrough to a distal tip of the flow nozzle.

23. The dual chamber dispenser of claim 22 wherein the nozzle includes mixing vanes.

24. A multi-component dispenser adapted to simultaneously dispense at least two components, the dispenser comprising:

a first chamber having a first end, a second opposite end, and a chamber wall extending therebetween, the first chamber defining an aperture at the first end;

a second chamber having a first end, a second opposite end, and a chamber wall extending therebetween, the second chamber defining an aperture at the first end of the second chamber;

a mixing assembly positioned adjacent the first ends of the first and second chambers, the mixing assembly defining (i) a valve receiving region, (ii) a first flow channel extending between the aperture defined at the first end of the first chamber and the valve receiving region, and (iii) a second flow channel extending between the aperture defined at the first end of the second chamber and the valve receiving region;

a single valve member disposed at least partially within the valve receiving region defined in the mixing asssembly, the member linearly positional between an open position and a closed position, the member defining a distal end which is exposed to both the first flow channel and the second flow channel upon the member being positioned to the open position and wherein the distal end is removed from both the first flow channel and the second flow channel upon the member being positioned to the closed position;

said first chamber housing a first flowable component having a first viscosity and having a first interior hollow region of a first cross section and a first flow-governing aperture having a first aperture size, said second chamber housing a second flowable component having a second viscosity and having a second interior hollow region of a second cross section and a second flow-governing aperture having a second aperture size;

said simultaneous dispensing at least two components being established by the proportions of said first cross section to said second cross section, said first aperture size to said second aperture size, and said first viscosity to said second viscosity; and, wherein the valve member defines a first deflection surface and a second deflection surface proximate the distal end.

25. The dispenser of claim 24 wherein the distal end of the valve member defines a pair of angled surfaces.

26. The dispenser of claim 25 wherein the surfaces are each concave.

27. The dispenser of claim 24 wherein upon positioning the valve member to the closed position the valve member blocks both the first flow channel and the second flow channel.

28. The dispenser of claim 24 further comprising a handle.

29. The dispenser of claim 24 wherein each of the first and second deflection surfaces are acutely angled with respect to each other.

30. The dispenser of claim 24 further comprising a dispensing tip in flow communication with the valve receiving region defined by the mixing assembly.

* * * * *